US006113426A

United States Patent [19]

Lin

[11] Patent Number: 6,113,426

[45] Date of Patent: Sep. 5, 2000

[54] CONNECTOR WITH IMPROVED SHIELD AND TERMINAL STRUCTURE

[75] Inventor: Cheng Te Lin, Taipei Hsien, Taiwan

[73] Assignee: Molex Incorporated, Lisle, Ill.

[21] Appl. No.: 09/188,515

[22] Filed: Nov. 9, 1998

[30] Foreign Application Priority Data

Nov. 10, 1997 [TW] Taiwan ..... 86218866

[51] Int. Cl.[7] ..... H01R 19/00

[52] U.S. Cl. ..... 439/607; 439/660; 439/939

[58] Field of Search ..... 439/607, 608, 439/609, 610, 676, 295, 108

[56] References Cited

U.S. PATENT DOCUMENTS

| | | | |
|---|---|---|---|
| 5,094,627 | 3/1992 | Uekido | 439/610 |
| 5,156,554 | 10/1992 | Rudoy et al. | 439/108 |
| 5,564,949 | 10/1996 | Wellinsky | 439/607 |
| 5,593,311 | 1/1997 | Lybrand | 439/295 |
| 5,702,271 | 12/1997 | Steinman | 439/676 |

FOREIGN PATENT DOCUMENTS

| | | | |
|---|---|---|---|
| 4004387A1 | 12/1990 | Germany | H01R 13/648 |
| 85210940 | 7/1996 | Taiwan | H01R 23/68 |
| 85216814 | 10/1996 | Taiwan | H01R 13/658 |
| 85216816 | 10/1996 | Taiwan | H01R 13/648 |

*Primary Examiner*—Neil Abrams
*Assistant Examiner*—Eugene G. Byrd

[57] ABSTRACT

An electrical connector disclosed comprises an insulative case including a terminal projection with opposed sides extending from the case. Terminal cavities extend through the case including grooves in both the said opposed sides of the terminal projection. A conductive shield surrounds a substantial portion of the case. A terminal is in each groove on both sides of the terminal projection. Each terminal comprises an elongated forward portion including a retention portion for holding the terminal in the case and an insertion portion extending from the cavity for connecting the terminal to a conductor. The terminal further includes a return portion extending from the forward portion and a contact portion extending from the return portion along the forward portion. The conductive shield surrounding the case may include a mating opening near the contact portions of the terminals. The shield includes first side portions opposed to second side portions with both side portions being adjacent to the mating opening. Two spaced-apart panel engaging fingers extend from near the first side portion and one panel engaging finger extends from the near the second side portion. The one panel engaging finger is laterally disposed between the two spaced-apart panel engaging fingers.

14 Claims, 12 Drawing Sheets

CONNECTOR WITH IMPROVED SHIELD AND TERMINAL STRUCTURE

FIELD OF THE INVENTION

The present invention generally relates to electrical connectors and particularly relates to an improved shielded electrical connector.

BACKGROUND OF THE INVENTION

Shielded electrical connectors are used to provide connections between electrical circuits through an interface that is free from electromagnetic interference. In connectors through which signals flow in and out of the interface with a mating connector, such as input/output connectors, shielding is especially important to maintain signal integrity. The Universal Serial Bus (USB) connector is an advanced shielded connector that can be serially integrated together with various such input/output connectors.

FIG. 1 shows a conventional USB connector 1, which generally comprises an insulating case 2 and a plurality of terminals 3. The insulating case 2 further comprises a terminal projection 22 extending upwardly from a bottom wall 24. The bottom wall includes terminal cavities 221 that extend upwardly along the terminal projection in terminal grooves 2211. A cap 223 at the end of the end of the terminal grooves includes lip portions 2231 which define terminal recesses 2223. The terminal projection 22 and side walls 21 of the case define an annular slot 23 for receiving a portion of a mating connector (not shown) therein.

Terminals 3 are loaded through the terminal cavities 221 into terminal grooves 2211. As shown in FIGS. 2 and 3, the contacts 3 are stamped and formed to have a contact portion 31 that includes a bent portion 32, a retention portion 34, an insertion portion 35 and an end portion 36. The contact portion defines a contact point 311. The bent portion 32 is connected to the retention portion at transition point 312. The contact portion 31 protrudes out of the terminal grooves 2211 into the slot 23 to engage terminals of a mating connector. The insertion portion 35 extends out of the bottom wall of the case 2, so that it can be fixed to the circuit board 5. The terminals 3 are inserted into the terminal grooves 2211 in the case 2 with the end portions 36 entering recesses 2223 and are retained therein. A retention portion 34 has barbs 341 for skiving into the walls of the terminal cavities to retain the terminals within the case 2.

The conventional shielded connector presents the following disadvantages. The elastic engagement force of the terminal 3 provided by the transition point 312 can be inadequate. When the terminal 2 provides inadequate engagement force, the signal transmission effect of contact 3 is not satisfactory. Accordingly, the length $L_1$ of the bent portion 32 must be sufficiently large to provide the contact portion with the necessary engagement force. Therefore, the length $L_2$ of the retention portion is sacrificed, diminishing its retention capacity. To ensure adequate retention capacity, the height $H_2$ of the insulative case 2 cannot be reduced. Therefore, the overall height $H_1$ of the connector must be greater to provide adequate engagement force and retention capacity.

Additionally, assembly of the contact 3 is cumbersome because the free end portion 36 must be inserted into recesses 2223 within lip portions 2231.

Moreover, although not shown in FIG. 1, shielded connectors such as USB connectors often have panel engaging members extending from the mating surface of the shield 4.

Such panel engaging fingers often extend forwardly and outwardly to making the connector more bulky and difficult to handle.

Therefore, an object of the present invention is to provide a shielded connector with a terminal structure that is easy to load and provides sufficient engagement force and retention capacity while minimizing the overall height of the connector.

It is also an object of the present invention to provide a shielded electrical connector with panel engaging fingers which are easily compacted with other such shielded connectors.

SUMMARY OF THE INVENTION

The present invention comprises an electrical connector having an insulative case including a terminal projection with opposed sides extending therefrom. Terminal cavities extend through the case and include grooves in both of the opposed sides of the terminal projection. A conductive shield surrounds a substantial portion of the case. A terminal is loaded in each groove on both opposed sides of the terminal projection. The terminals comprise an elongated forward portion including a retention portion for holding the terminal in the case and an insertion portion extending from the case for connecting the terminal to a conductor. The terminal includes a return portion extending from the forward portion and a contact portion extending from the return portion along the forward portion. The contact portion preferably has an outwardly inclined portion extending from the return portion and an inwardly inclined portion extending from the outwardly inclined portion to define a contact point. The terminal further includes a rearward bight portion extending from the inwardly inclined portion.

The terminal projection may further include a forward recess in each of the terminal grooves for receiving the return portion of the terminals. Moreover, the forward recess may be defined by a cap portion at a forward end of the terminal projection and a retaining lip extending along the terminal groove. To provide further stability, the insulative case may include side walls extending along the terminal projection.

In another embodiment of the present invention the shielded electrical connector comprises an insulative case including terminal cavities extending through the case and a terminal in each terminal cavity having a contact portion and a tail portion extending from the case. The connector further includes a conductive shield surrounding the case and a defining a mating opening near the contact portions of the terminal. The shield includes a first side portion opposed to a second side portion. Both side portions are adjacent to the mating opening in the shield. Two spaced-apart panel engaging fingers extend from near the first side portion and one panel engaging finger extends from near the second side portion. The one panel engaging finger extending from near the second side portion is laterally disposed between the two spaced-apart panel engaging fingers extending from the first side portion.

Preferably, as disclosed herein, the electrical connector may have an opening in a front portion of the shield having a first edge opposed to a second edge wherein the first edge is wider than the second edge. Moreover, inwardly folded latch members may extend over third and fourth opposed edges of the opening.

BRIEF DESCRIPTION OF THE DRAWINGS

The various objects and advantages of the present invention will be more readily understood from the following detailed description when read in conjunction with the appended drawings in which.

DETAILED DESCRIPTION OF THE PREFERRED EMBODIMENTS

Figure 1:
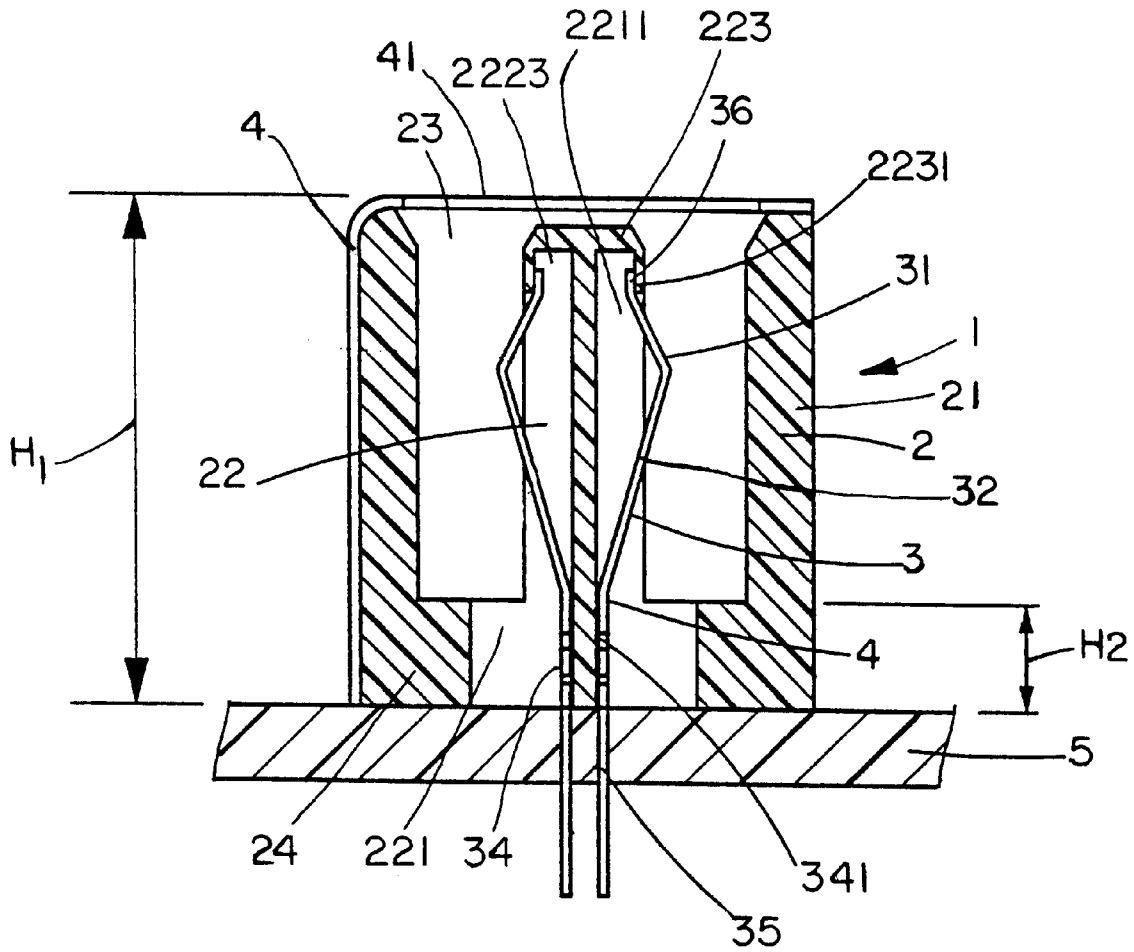
FIG. 1 (PRIOR ART)
FIG. 1 is a cross-sectional view of a conventional shielded connector.
Figure 3:
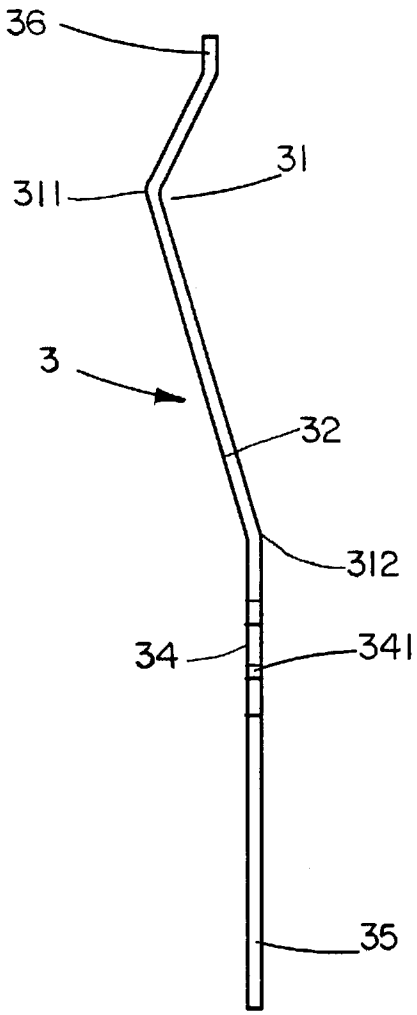
FIG.3 (PRIOR ART)
FIG. 3 is a side elevational view of the terminal of the connector shown in FIG. 2.
Figure 2:
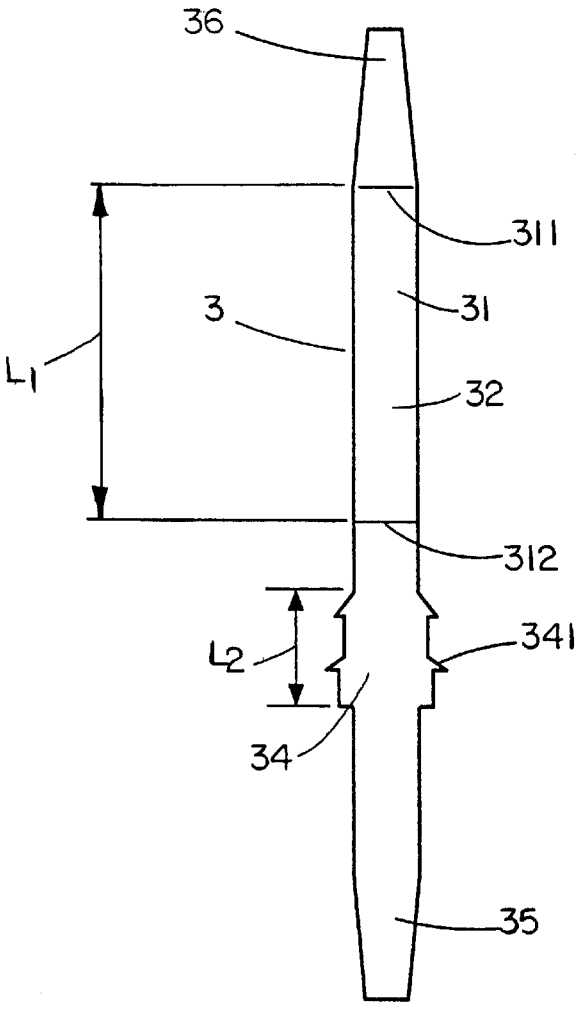
FIG.2 (PRIOR ART)
FIG. 2 is a front elevational view of a contact of the connector shown in FIG. 1.
Figure 4:
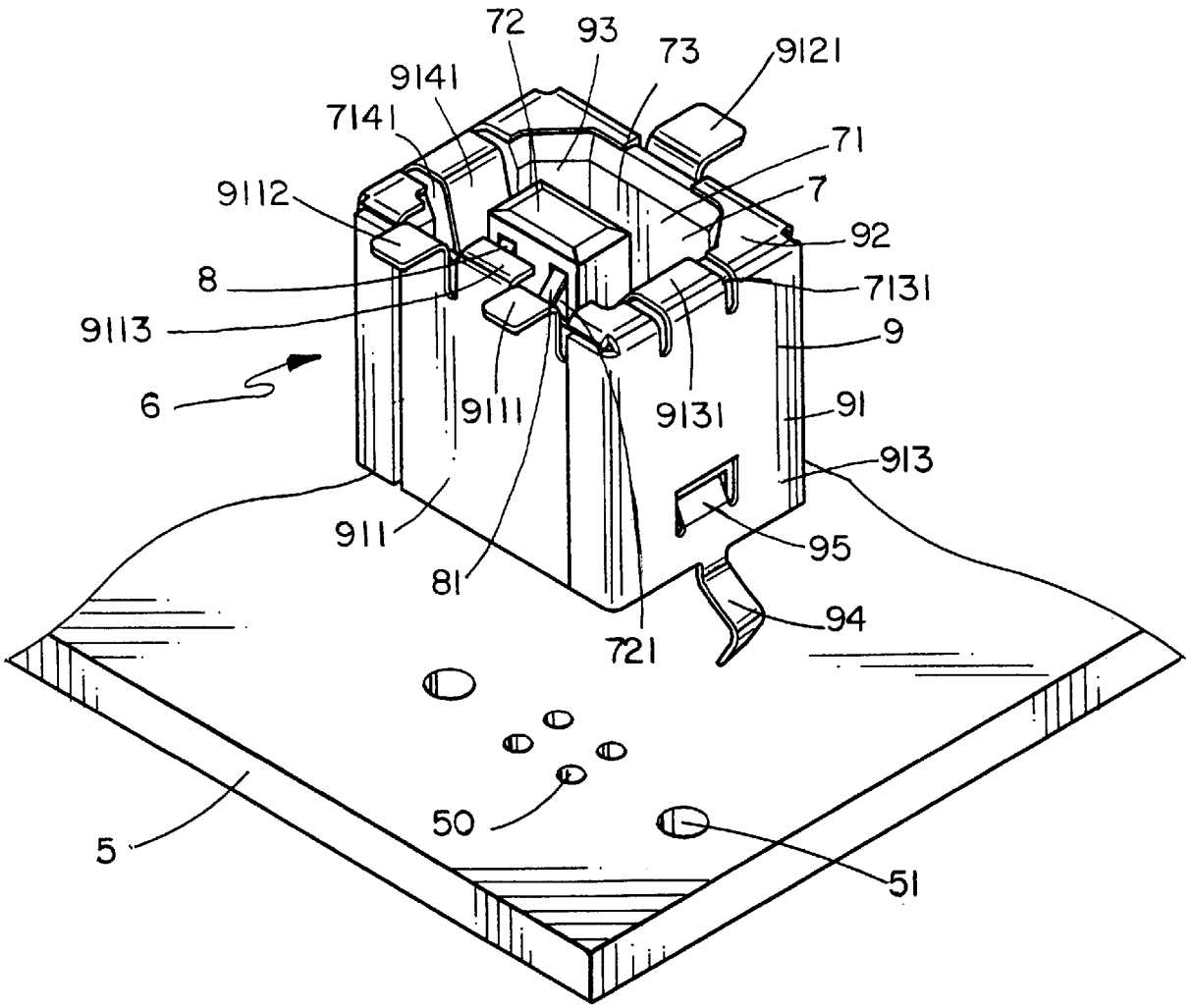
FIG. 4 is perspective view of an embodiment of the connector of the present invention.
Figure 6:
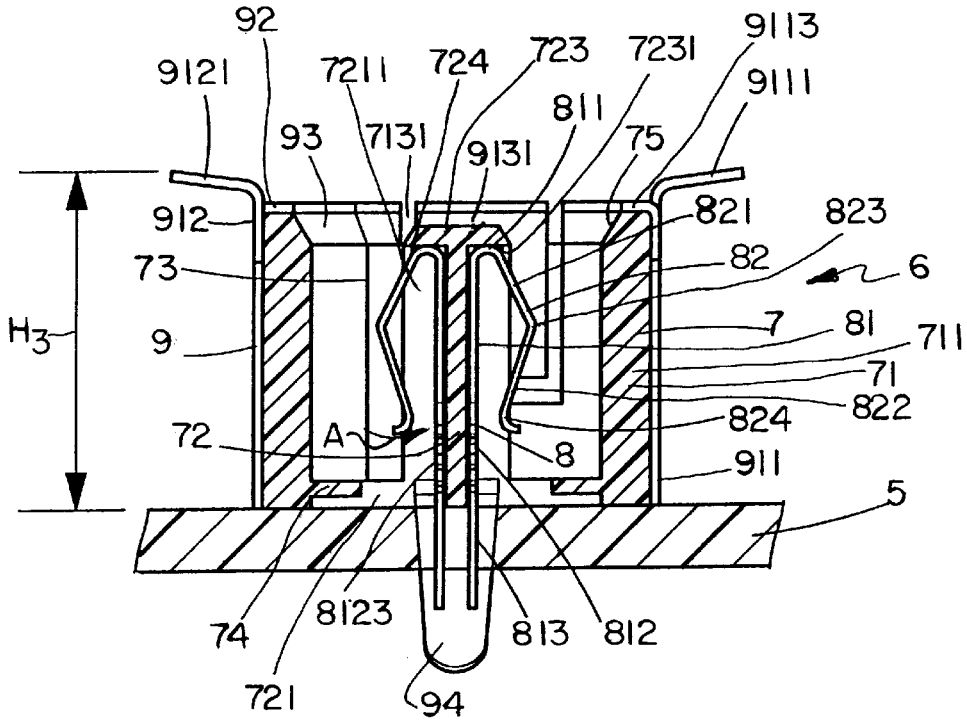
FIG. 6 is a cross-sectional view of the connector taken along segment 6—6 in FIG. 5.

The shielded electrical connector generally designated 6, of the present invention is shown in perspective in FIG. 4. The electrical connector comprises an insulative case generally designated 7, having side walls 71 and a terminal projection 72 with terminal cavities 721 (FIG. 6). Terminals, generally designated 8, are loaded into terminal cavities 721 in the terminal projection 72. The terminal projection 72 and the side walls 71 of the case define an annular slot 73 for receiving a mating connector (not shown) therein. Contact portions 82 of terminals 8 extend out of the terminal projection to engage terminals of the complementary mating connector to effect electrical connection.

The insulative case 7 is surrounded by a conductive shield, generally designated 9. The shield comprises side portions 91 and a mating portion 92. A mating opening 93 is provided in the mating portion 92. Board engaging legs 94 descend from side portions 913 and 914, respectfully. Leg portions 94 are inserted into respective through holes 51 to anchor the connector 6 to board 5.

FIG. 6 illustrates a cross-section of the connector in FIG. 4. Each terminal cavity 721 extends through a bottom wall 74 of the case 7 and includes a respective terminal groove 7211. Terminal grooves 7211 extend along both opposed sides of said terminal projection 72. The terminal grooves 7211 terminate at recesses 724 defined by a cap 723 at the end of the terminal projection 72 and a respective lip portion 7231.

Figure 8:
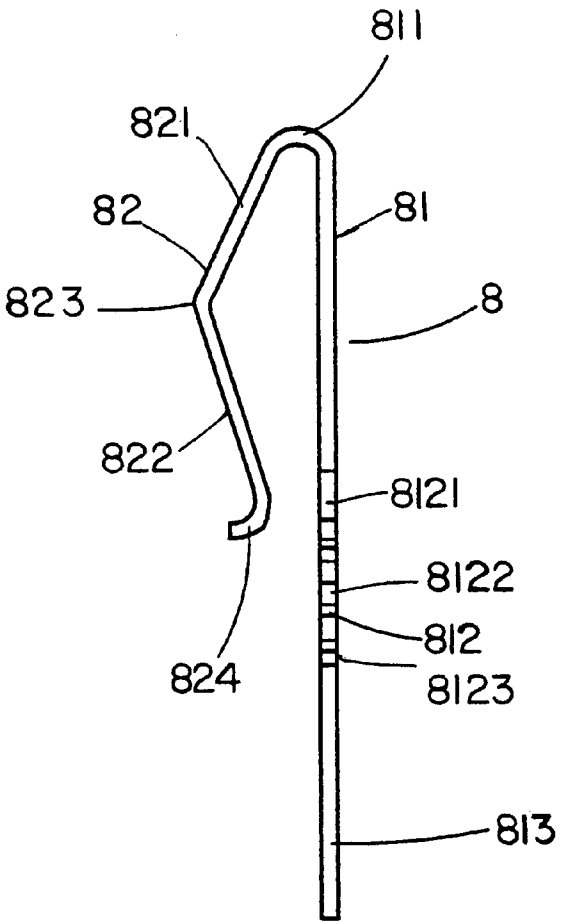
FIG. 8 is a side elevational view of the terminal in FIG. 7.
Figure 7:
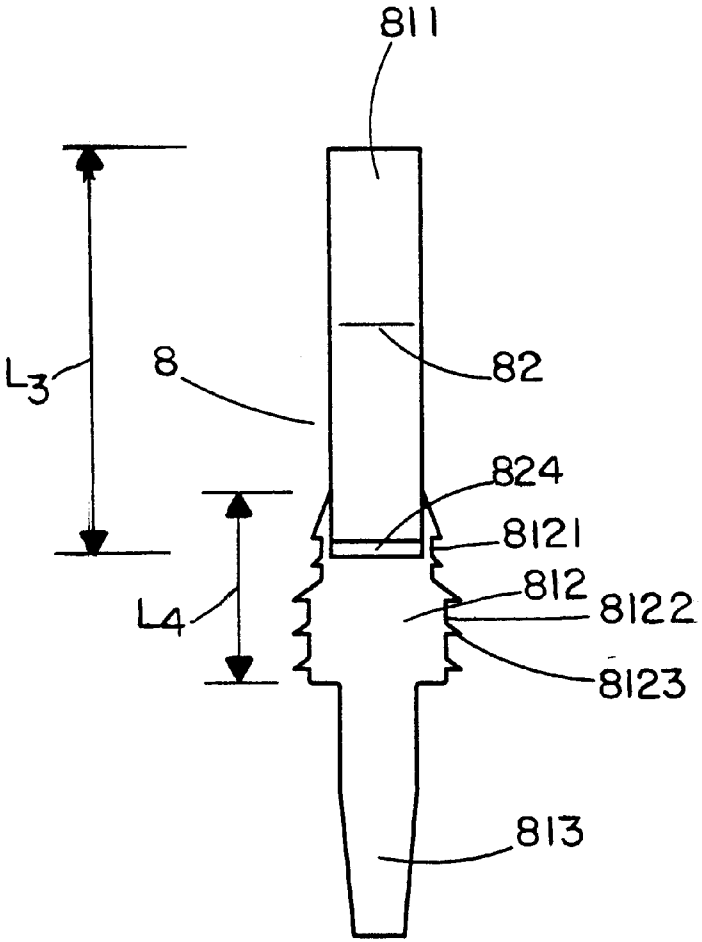
FIG. 7 is a front elevational view of the terminal in the connector of FIG. 4.

FIG. 6 illustrates how the terminals 8 are situated in the connector 6 of the present invention. With reference to FIGS. 7 and 8, each terminal has an elongated forward portion 81 joined to the contact portion 82 at a forward return or bight portion 811. The forward portion includes a retention portion 812 comprising a front section 8121 and a rear section 8122 which is wider than the front section 8121. Barbs 8123 on the retention portion serve to skive into the walls of terminal cavity 721 and retain terminals 8 therein when inserted into the terminal cavities 721. The forward portion 81 of the terminals 8 also includes an insertion portion 813. When the connector 6 is mounted on the circuit board 5 insertion portions 813 enter through-holes 50 and are soldered therein to connect the terminals 8 to respective conductors on the circuit board 5. The terminals 8 further comprise a contact portion 82 comprising an outwardly inclined portion 821 and an inwardly inclined portion 822 joined by an intermediate bight portion or contact point 823.

The angular relationship between the forward portion 81 and the contact portion 82 at the return portion 811 of terminals 8 facilitates entry of return portion 811 inwardly of the lip portion 7231 into recesses 724. Consequently, terminals 8 are inserted into the case 7 much more easily than are the terminals of conventional connectors.

When a complementary electrical connector is inserted into slot 73 in connector 6, the terminals of the complementary mating connector engage the terminals 8 at contact points 823 which extend into the slot 73 from the terminal grooves 7211. This engagement forces the contact portions 82 inwardly in the direction of arrow A (FIG. 6) toward retention portion 812. If the rearward bight portion 824 of contact portion 82 flexes all the way inwardly to engage the retention portion 812, the retention portion 812 provides a counterforce which boosts the engagement force of contact portion 82. Moreover, the 1800 bend of the return portion enhances the engagement force of the contact portion 82. By boosting the engagement force of the contact portion 82 in this manner, the length $L_3$ of the contact portion 82 need not be as relatively long. Additionally, because the contact portion 82 laterally overlaps with retention portion 812, the length $L_4$ of the retention portion 812 is not sacrificed in favor of length $L_3$ of contact portion 82. Consequently, length $L_4$ of the retention portion 812 can be greater than in the conventional terminal. Accordingly, terminal 8 can be more firmly retained in the insulative case 7. The unique terminal structure allows connector 6 to have a smaller overall height $H_3$ when compared to height $H_1$ of the conventional shielded connector.

The shield 9 of the electrical connector 6 comprises four side portions 91 and a mating portion 92. Side portions 91 comprise a first side portion 911 and three side portions 912, 913 and 914 which are all bent and orthogonally depend from mating portion 92. A first side portion 911 is opposed to a second side portion 912. The third and fourth opposed side portions 913 and 914 have flange sections that bend over and abut edge sections of first side portion 911 to secure all the side portions 91 together. First side portion 911 has panel engaging fingers 9111 and 9112 extending upwardly and outwardly from a mating edge thereof. The first side portion 9111 also has an inwardly bent flange 9113 extending over side wall 711. The second side portion 912 has a single panel engaging finger 9121 extending upwardly and outwardly from a mating edge thereof. When the connector 6 is mounted against a conductive panel (not shown) with the mating opening 93 registered with an opening in the panel, the panel engaging fingers 9111, 9112 and 9121 engage the panel around the periphery of the opening therein. The panel engaging fingers 9111 and 9112 on side portion 911 are spaced apart, so that panel engaging finger

Figure 9:
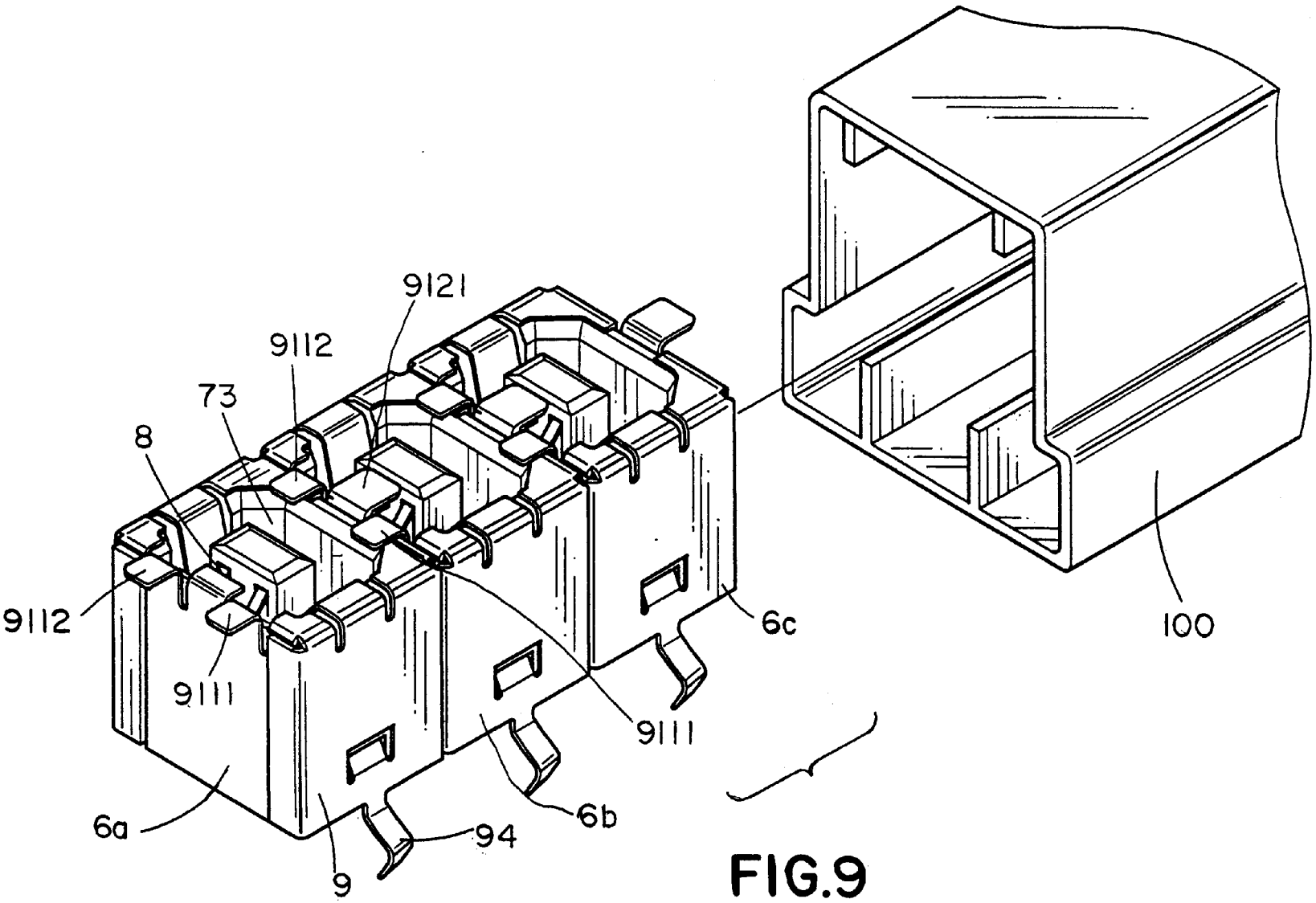
FIG. 9 shows an array of the connectors of FIG. 4 placed side by side of each other.

9121 is laterally disposed in between panel engaging fingers 9111 and 9112. Consequently, as shown in FIG. 9, a row of connectors 6*a*, 6*b* and 6*c*, can be compactly placed together with the panel engaging fingers 9111 and 9112 of connector 6*b*, for example, receiving panel engaging finger 9121 of an adjacent connector 6*a*. Accordingly, a row of connectors 6 configured as shown in FIG. 9 can be compactly arranged to conserve space in a linear direction of a packing tube 100.

Figure 5:
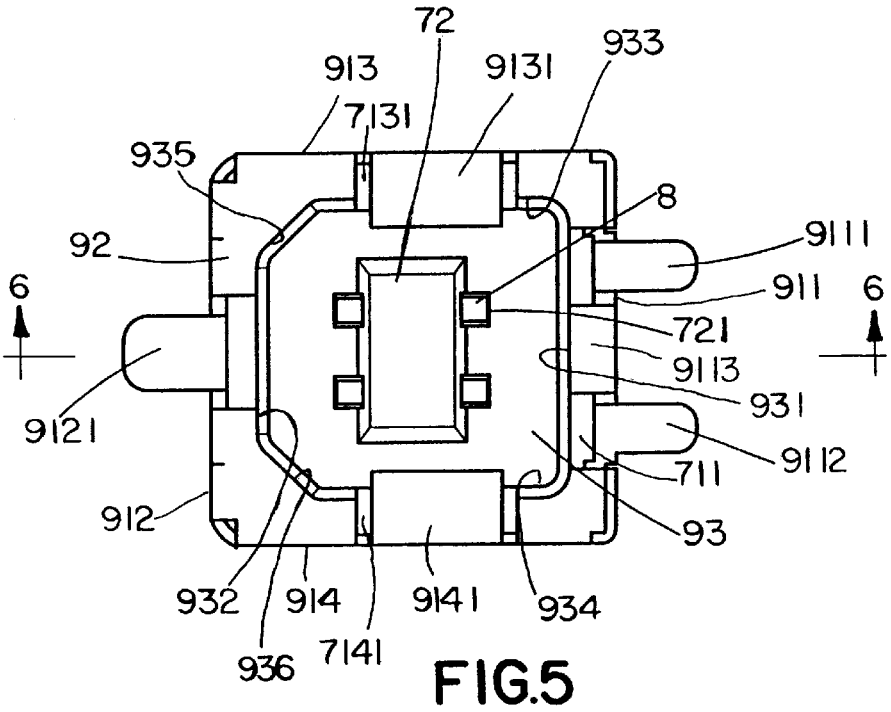
FIG. 5 is top plan view of the connector in FIG. 4.

The mating opening 93 will preferably only allow entry of a complementary mating connector that has a hexagonal lateral profile. Accordingly, as shown in FIG. 5, the opening 93 has a first edge 931 partially defined by flange 9113 and an opposed second edge 932. Moreover, the opening has third and fourth edges, 933 and 934 respectively. Fifth and sixth angular edges 935 and 936 are joined to opposite ends of the edge 932. The first edge 931 is wider than the second edge 932. Side portions 913 and 914 of the shield 9 also include inwardly bent latches 9131 and 9141, respectively, which extend from a mating edge of side portions 913 and 914, respectively, over edges 933 and 934, respectively, into slot 73 of the casing 7. Ends of latches 9131 and 9141 engage embossments of an outer portion of a complementary mating connector inserted into the slot 73 to secure the complementary mating connector therein. Gaps 7131 and 7141 in side walls 713 and 714, respectively, allow latches 9131 and 9141 to flex outwardly freely. Side portions 913 and 914 also include inwardly turned flanges 95 that engage recesses in side walls 713 and 714, respectively, in the case 7 to secure the shield 9 on the case 7.

Figure 10:
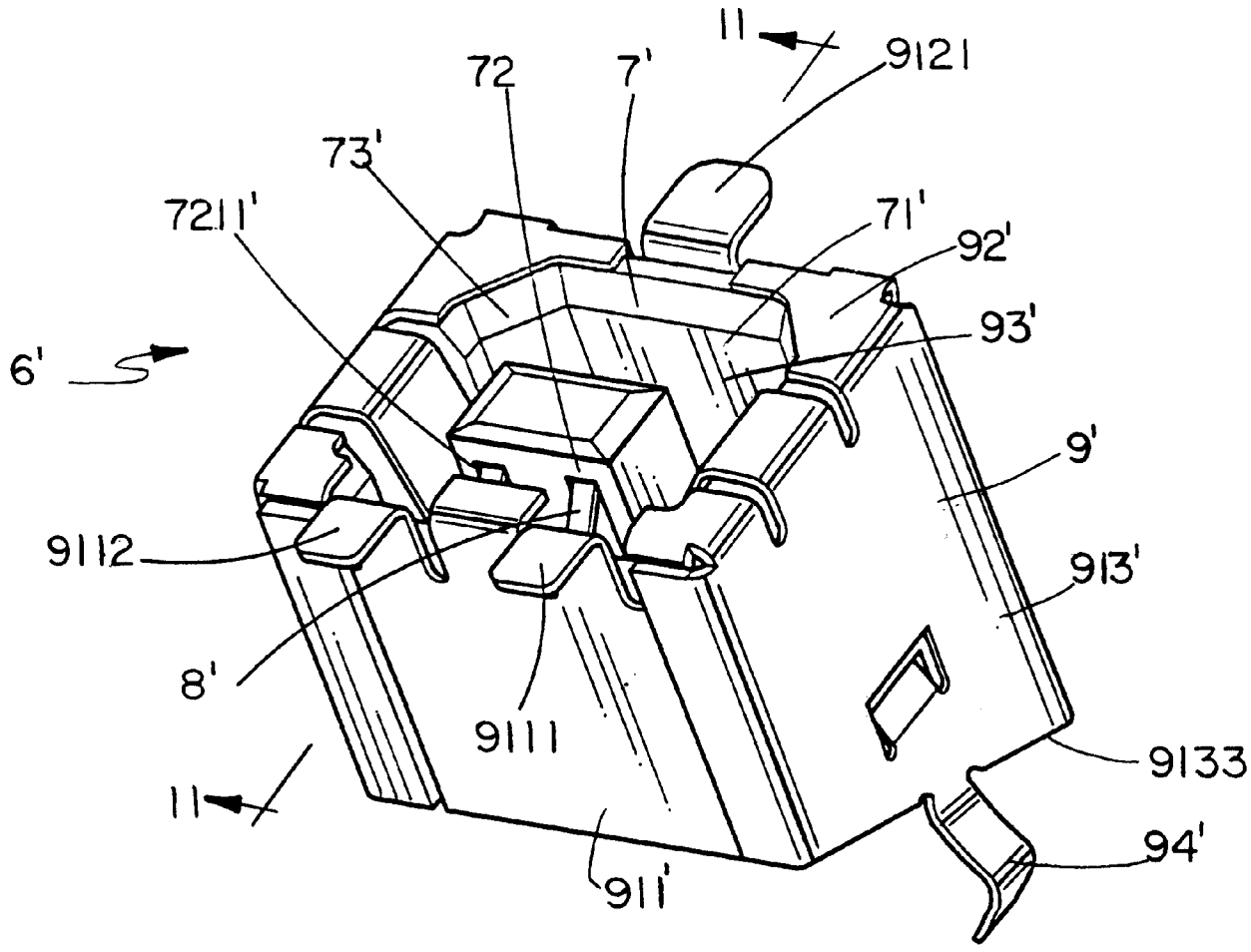
FIG. 10 is a perspective view of an alternative embodiment of the connector of the present invention.
Figure 11:
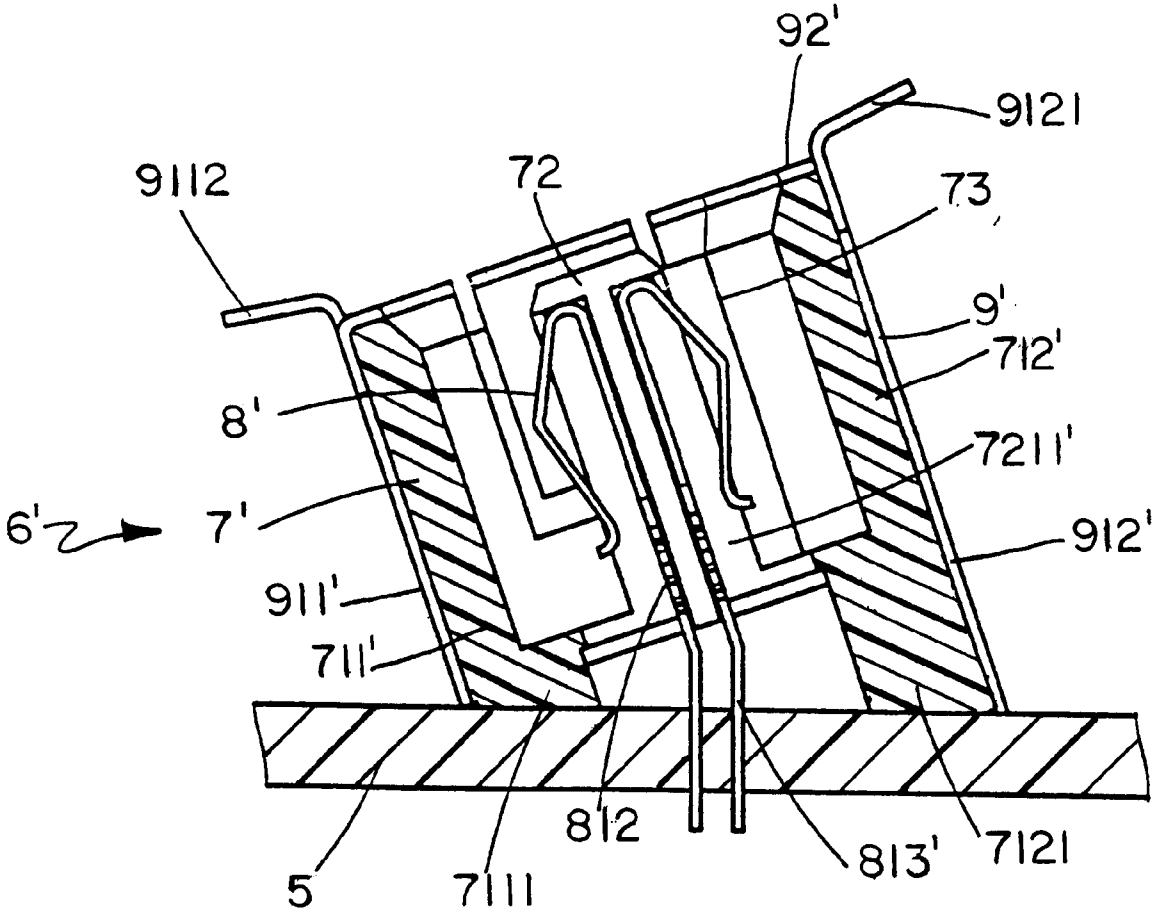
FIG. 11 is a cross-sectional view along segment 11—11 in FIG. 10.
Figure 12:
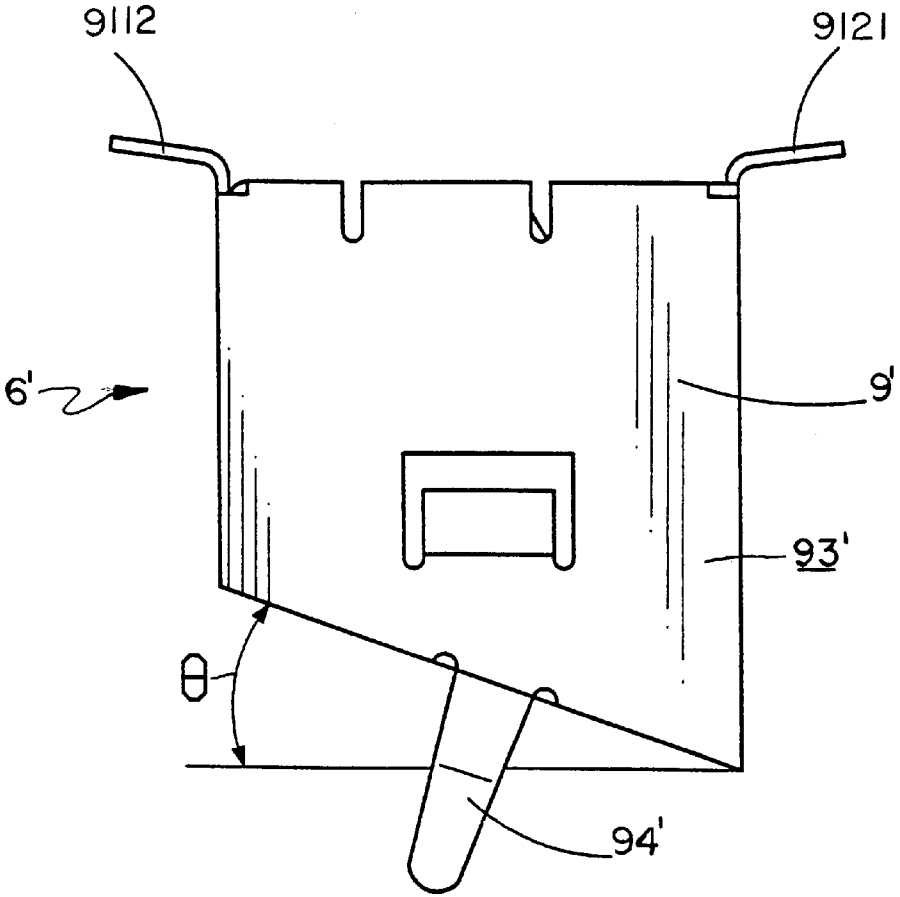
FIG. 12 is a side elevational view of the connector in FIG. 10.

FIGS. 10–12 show an alternative embodiment of the present invention. Like numbers will be used to designate elements in the alternative embodiment that are similarly structured as elements in the previously described embodiment. Reference numerals marked with a "'" designate elements in the alternative embodiment structured differently from the corresponding element in the previously described embodiment designated with the same root reference number. FIG. 10 shows the connector, generally designated 6', of the alternative embodiment. It has a very similar structure as the connector 6 in the previous described embodiment with a few exceptions. As best seen in FIG. 10, side portion 913' has a lower edge 9133 which is angularly related to the adjacent corners of the side portions 913'. Although not shown in FIG. 10, the opposite side portion 914' of the shield 9' has a similar configuration. Additionally, as best seen in FIG. 11, side portion 911' of the shield 9' is shorter than the side portion 912'. Consequently, the connector 6' and, particularly, the mating portion 92' are oriented angularly with respect to a top surface of circuit board 5 upon which connector 6' is mounted. It can be seen in FIG. 12 that angle θ determines the angle of orientation that the mating face makes with respect to the top surface of the circuit board 5.

FIG. 11 also shows that side walls 711' and 712' have additional extensions 7111 and 7121 which serve to orient case 7' angularly with respect to the board 5. Although it is not shown in the Figures, sidewalls 713' and 714' may have additional triangular extensions having a small angle θ to provide additional support for the connector 6'. Terminals 8' have insert portions 813' which are angled with respect to the retention portion 84 to accommodate the angular orientation of connector 6' with respect to the board 5.

The connector 6' may be mounted on a circuit board that is so crowded with components that a connector cannot enter the mating opening 93' from a horizontal or vertical direction with respect to the circuit board 5. Alternatively, the connector 6' can be mounted with its mating portion 92 facing a conductive panel (not shown) which is mounted at an angle θ with respect to the support surface such as circuit board 5. In such an arrangement, panel engaging fingers 9111, 9112 and 9121 will engage such a panel as previously described with respect to connector 6.

Figure 13:
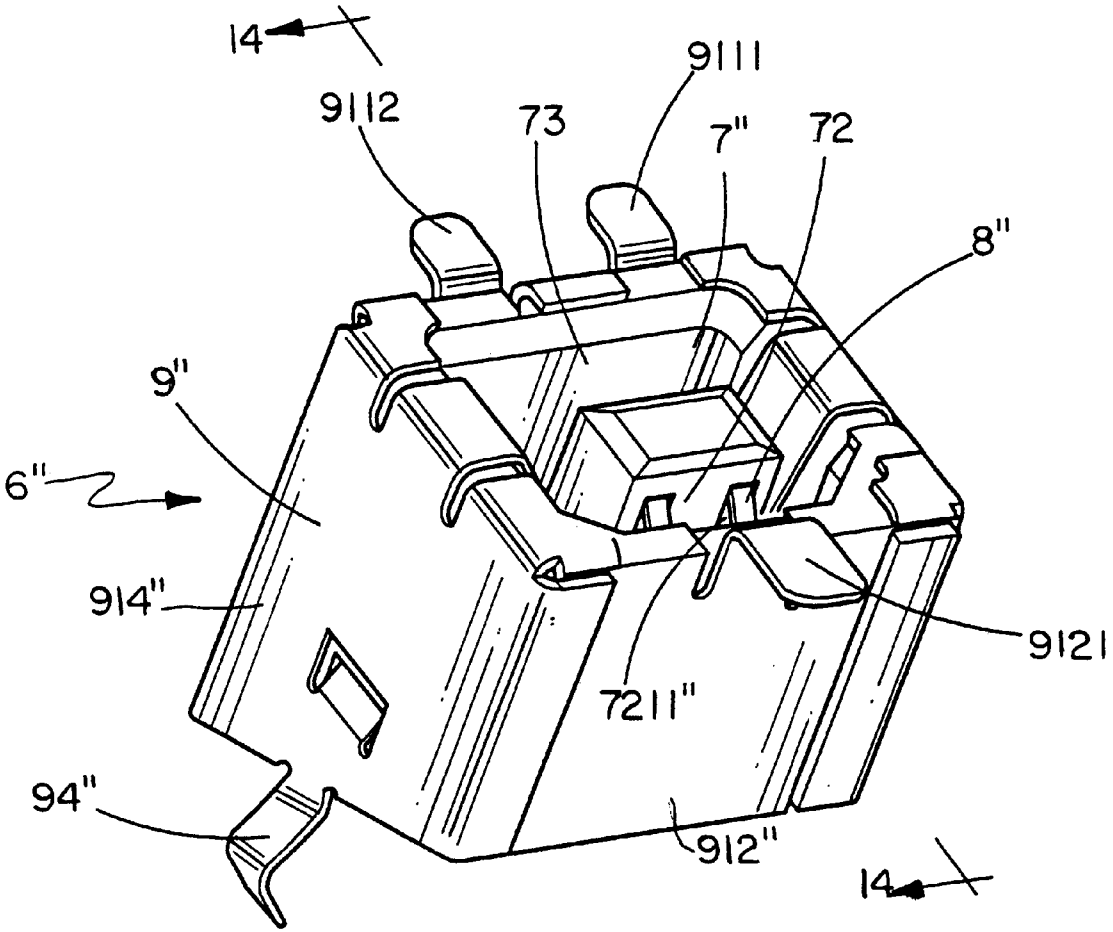
FIG. 13 is an additional alternative embodiment of the connector in FIG. 10.
Figure 14:
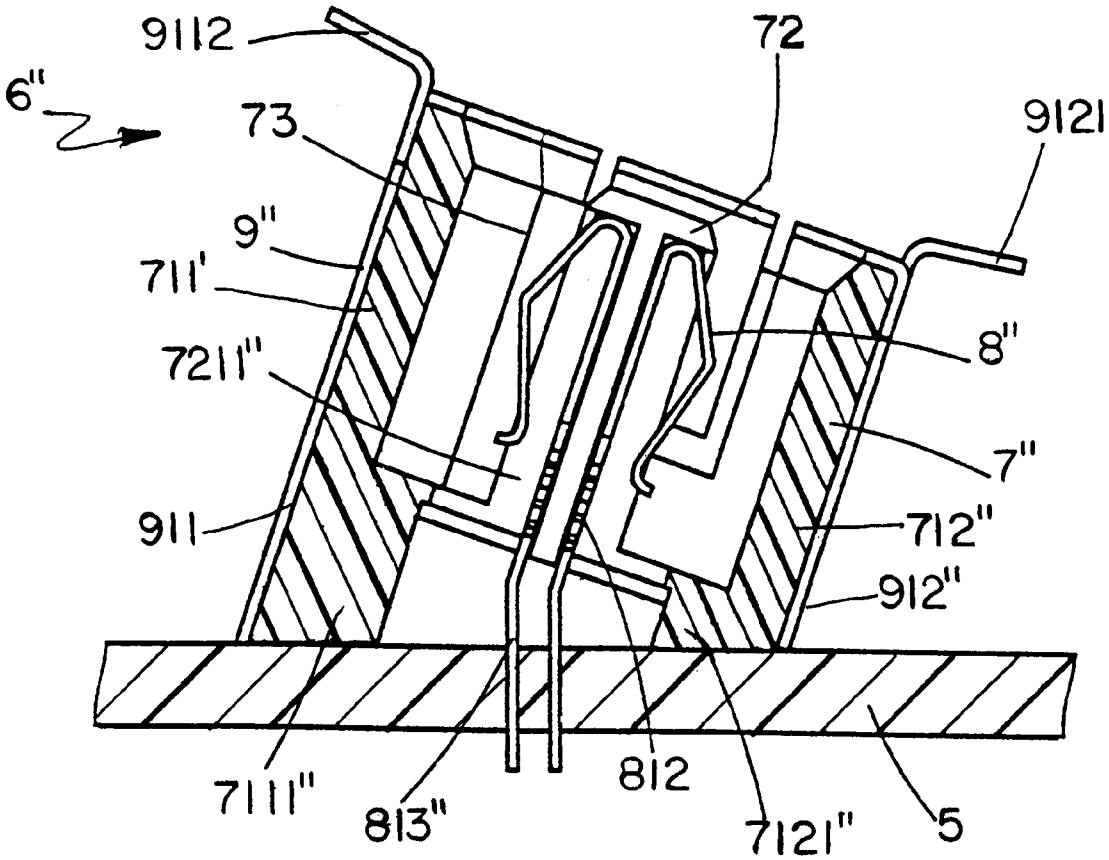
FIG. 14 is a cross-sectional view taken along segment 14—14 of FIG. 13.
Figure 15:
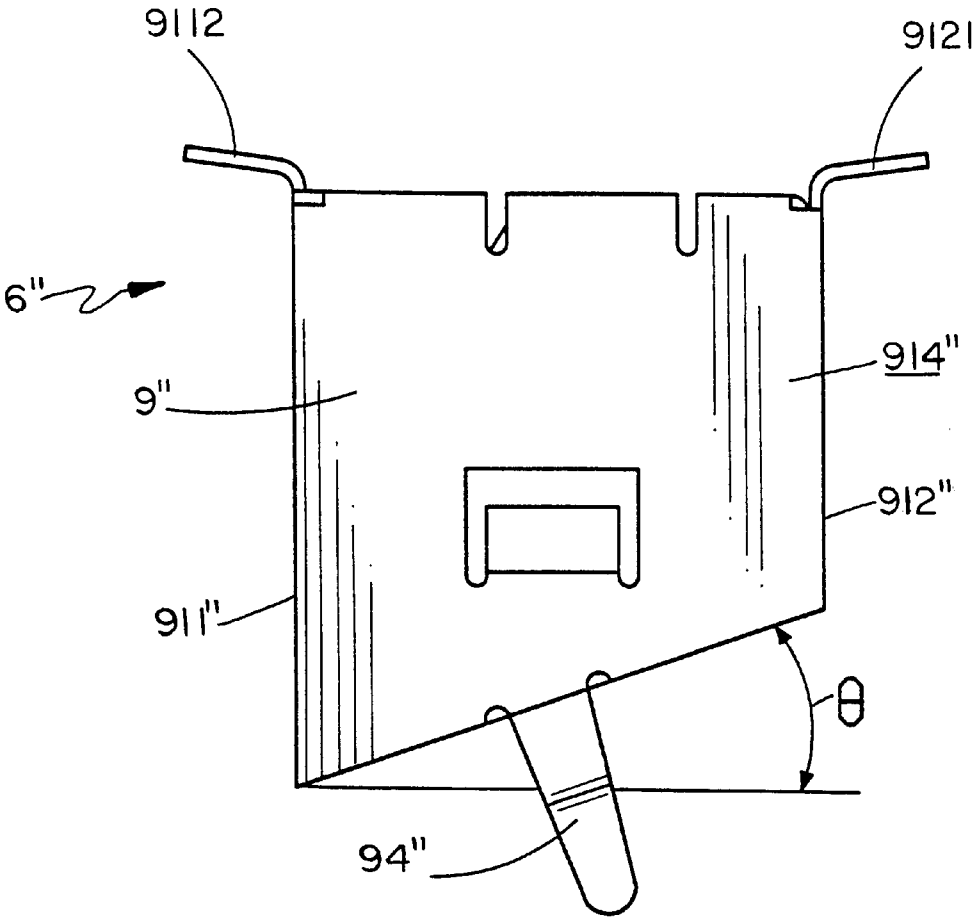
FIG. 15 is a side elevational view of the connector in FIG. 13.

FIGS. 13–15 show an additional alternative embodiment of the present invention. Like numbers designate elements which have structures similar to previously described embodiments. Additionally, reference numerals marked with a "'" designate elements with a structure that is different from a corresponding element in a previously described embodiment designated with the same root reference number.

The connector 6" differs from connector 6' in that the shield portion 911" and side wall 711" with extension 7111" is taller than the side portion 912" and side wall portion 712" with extension 7121". Consequently, the connector 6" and, particularly, the mating portion 911' are oriented angularly with respect to a top surface of circuit board 5 upon which connector 6" is mounted. The angular orientation of connector 6" is obverse to that of connector 6'. All other elements of the additional alternative embodiment differ in structure from the alternative embodiment accordingly.

Although the present utility has been described with reference to the preferred embodiment thereof, it will be understood that the utility is not limited to the details thereof. Various substitutions and modifications have been suggested in the foregoing description, and other will occur to those of ordinary skill in the art. Therefore, all such substitutions and modifications are intended to be embraced within the scope of the utility as defined in the appended claims. For example, the claimed invention is described with respect to an upright connector with through hole mounted terminals, it is anticipated that the present invention can be applicable to connector with different orientations and different terminal mounting configurations.

What is claimed is:

1. An electrical connector comprising:

an insulative case including a terminal projection with opposed sides extending from said case and terminal cavities extending through said case including grooves in both of said opposed sides of said terminal projection;

a conductive shield surrounding a substantial portion of said case;

a terminal in each groove on both opposed sides of said terminal projection, each terminal comprising an elongated forward portion including a retention portion for holding the terminal in the case and an insertion portion extending from the cavity for connecting the terminal to a conductor, a return portion extending from said forward portion and a contact portion extending from said return portion along said forward portion, said insertion portion being linearly aligned with said forward portion.

2. The electrical connector of claim 1, wherein said contact portion includes an outwardly inclined portion extending from said return portion and an inwardly inclined portion extending from said outwardly inclined portion.

3. The electrical connector of claim 2, wherein said contact portion further includes a rearward bight portion extending from said inwardly inclined portion.

4. The electrical connector of claim 1, wherein said terminal projection includes a forward recess in each of said terminal grooves for receiving the return portion of the terminals.

5. The electrical connector of claim 1, wherein said forward recess is defined by a cap portion at a mating end of the terminal projection and a retaining lip extending along said terminal groove.

6. The electrical connector of claim 1, wherein said return portion is a bight.

7. The electrical connector of claim 1, wherein said insulative case includes side walls extending along the terminal projection.

8. An electrical connector comprising:

an insulative case including a terminal projection extending therefrom, and terminal cavities including grooves at said terminal projection and extending through said case;

a conductive shield surrounding a substantial portion of said case;

a terminal in each terminal cavity comprising an elongated forward portion including a retention portion for holding the terminal in the case and an insertion portion extending from the case for connecting the terminal to a conductor, said elongated forward portion being joined to a forward bight portion, a contact portion joined to said forward bight portion, said contact portion extending along said forward portion, said contact portion including an outwardly inclined portion directly joined to said forward bight portion, an intermediate bight portion extending from said outwardly inclined portion, an inwardly inclined portion extending from said intermediate bight portion, and a rearward bight portion extending from said inwardly inclined portion.

9. The electrical connector of claim 8, wherein said terminal projection includes a forward recess in each of said terminal grooves for receiving the forward bight portion of the terminals.

10. The electrical connector of claim 8, wherein said forward recess is defined by a cap portion at a forward end of the terminal projection and a retaining lip extending along the terminal groove.

11. A shielded electrical connector comprising:

an insulative case including terminal cavities extending through said case;

a terminal in each terminal cavity having a contact portion and an insertion portion extending from said case;

a conductive shield surrounding said case and defining a mating opening near said contact portions of said terminals, said shield including a first side portion opposed to a second side portion, both side portions being adjacent to said mating opening in said shield, two spaced-apart panel engaging fingers extending from near said first side portion and one panel engaging finger extending outwardly from near said second side portion, said one panel engaging finger extending from said second side portion being laterally disposed between said two spaced-apart panel engaging fingers extending from said first side portion.

12. The shielded electrical connector of claim 11, wherein said mating opening in said shield has a first edge opposed to a second edge and said first edge is wider than said second edge.

13. The electrical connector of claim 11, wherein said mating opening in said shield also has third and fourth opposed edges, and an inwardly folded latch member extends from each of said third and fourth opposed edges.

14. The electrical connector of claim 11, wherein said terminal in each cavity comprises an elongated forward portion including a retention portion and an insertion portion, a return portion extending from said forward portion and a contact portion extending from said return portion along said forward portion.

* * * * *